US010470509B1

(12) United States Patent
Knott

(10) Patent No.: US 10,470,509 B1
(45) Date of Patent: Nov. 12, 2019

(54) FAR INFRARED-BASED ATHLETIC APPAREL GARMENT AND METHOD OF USE THEREOF

(71) Applicant: Brannan Knott, Baltimore, MD (US)

(72) Inventor: Brannan Knott, Baltimore, MD (US)

( * ) Notice: Subject to any disclaimer, the term of this patent is extended or adjusted under 35 U.S.C. 154(b) by 1417 days.

(21) Appl. No.: 13/839,345

(22) Filed: Mar. 15, 2013

(51) Int. Cl.
*A41D 31/04* (2019.01)

(52) U.S. Cl.
CPC ..... *A41D 31/04* (2019.02)

(58) Field of Classification Search
CPC ..... D02G 3/00; A41D 13/00
See application file for complete search history.

(56) References Cited

U.S. PATENT DOCUMENTS 5,138,132 A * 8/1992 Baurle ..... B23K 9/095 219/130.51
5,466,526 A * 11/1995 Magata ..... A41B 9/00 428/364
5,636,380 A * 6/1997 Schindler ..... A41B 11/00 2/69
5,958,328 A * 9/1999 Seok ..... D01F 1/10 264/140
6,264,967 B1 * 7/2001 Ito ..... A01N 25/34 424/402
7,428,772 B2 * 9/2008 Rock ..... A41D 13/002 28/159
2004/0225049 A1 * 11/2004 Komuro ..... C08K 3/08 524/403
2013/0253397 A1 * 9/2013 Samoodi ..... A41D 1/20 602/19
2016/0076170 A1 * 3/2016 Blaney ..... D01D 5/0985 428/212
2016/0331054 A1 * 11/2016 Coza ..... B32B 27/12

OTHER PUBLICATIONS http://www.firheals.com/store/index.php?route=product/category&path=59_62 (2004-2017).*
http://apparel.edgl.com/old-magazine/Competition-Intensivies-as-Performance-Apparel-Advances-(Marketplace—Update)64725 (Jan. 2005).*
http://www.innovationintextiles.com/ancient-wisdom-inspires-responsive-far-infrared-fibres/ (Apr. 2013).*
http://sportslink.biz/study-shows-apparel-fibre-boosts-performance-cms-2995 Nov. 9, 2015).*

* cited by examiner

*Primary Examiner* — Arti Singh-Pandey
(74) *Attorney, Agent, or Firm* — William S. Parks

(57) ABSTRACT

An apparel garment that includes individual fibers exhibit proper moisture wicking properties and that have been infused or coated (or both) with far infrared materials is provided. The combination of suitable fibers and far infrared materials imparts a unique effect to the apparel garment wherein the far infrared materials will physiologically and therapeutically impact the user's circulatory system to dilate surface capillaries, break down water clusters, and allow for toxin removal at the apparel/skin interface. Coupled with the overall moisture wicking capability, surprisingly the inventive garment actually provides a cooling effect during an exercise event in a warm temperature environment and a warming effect during an exercise event in a cold temperature environment. The utilization of such a garment to impart such an exercise-activated cooling or warming effects, and thus the ability to allow the user greater comfort during any type of workout, is also encompassed within this invention.

11 Claims, 6 Drawing Sheets

FAR INFRARED-BASED ATHLETIC APPAREL GARMENT AND METHOD OF USE THEREOF

FIELD OF THE INVENTION

This invention pertains to an apparel garment that includes individual fibers exhibit proper moisture wicking properties and that have been infused with, coated with, or both, far infrared materials. The combination of suitable fibers and far infrared materials imparts a unique effect to the apparel garment wherein the far infrared materials will function to physiologically and therapeutically with the user's circulatory system to dilate surface capillaries, break down water clusters, and allow for toxin removal at the apparel/skin interface. Coupled with the moisture wicking capability of the fibers, as well as the lightweight and low profile structure of the garment, surprisingly the inventive apparel fabric has been found to accord a suitable and beneficial cooling effect during an aerobic exercise event (as opposed to typical far infrared heating results) in a warm temperature environment (and also provides a heating effect in lower temperature situations, such as for a person running in cold weather, for instance). The utilization of such a garment to impart such an exercise-activated cooling effect, or conversely a heating capability, on demand and in relation to the temperature of the immediate environment for the athlete himself or herself, and thus the ability to allow the user greater comfort during a workout in either type of situation, is also encompassed within this invention.

BACKGROUND OF THE INVENTION

Athletic exercise has continued to grow in popularity for many reasons and for many years. Whether it be for the purpose of improving one's own health status, train for specific athletic events and sports, or even if for the basis of one's actual chosen profession, there has been and still remains a significant need, if not large segment of society, that undertakes athletic or other fitness activity of many different types and levels. Of great importance in any of these endeavors is the necessity for comfort for the athlete in question, whether a novice or a professional. As is well known and documented, any time aerobic (or anaerobic) activity occurs, the level of intensity as well as the actual status of the athlete himself or herself may create certain effects that can reduce the ultimate end result sought. For instance, a person's heart rate will invariably increase when active, setting off a chain of events involving increased blood flow, body temperature increase, carbon dioxide (and other waste products) generation, etc. The ability of the athlete in question to sustain the desired level of activity many times depends highly upon the capability of his or her body to regulate such physiological events, particularly as it concerns the necessity to avoid overheating, cramping, and/or strains on their circulatory system. For many persons, the simple answer has been to utilize cool-down intervals (sometime too often for effective workout results to take hold) if not wear certain materials that effectuate wicking of sweat and other moisture. As the body regulates its own temperature through perspiration during such activities, the ability to dissipate heat in this manner has proven somewhat successful. Adding to it the potential for external cooling sources (i.e., fans, for instance), particularly within a closed environment (i.e., gymnasium), the athlete has at least been presented with a certain degree of possible alternatives to overheating issues.

It should be evident, however, that overheating poses significant problems for athletes as well as individuals that are trying to initiate athletic activity (such as, for example, persons seeking weight loss). Lightheadedness, a lack of proper heat dissipation, and other effects associated with a lack of suitable body temperature regulation, can lead to undesirable health effects and, quite possibly, the opposite result sought through such a workout regimen. Not to mention, if the level becomes too uncomfortable (if not unbearable), the target person may become disenchanted with such an athletic activity, to his or her detriment ultimately. In other words, there is a great need to provide an effective manner of generating a comfortable workout condition for the athlete in question, but without compromising the overall level of activity needed and/or desired.

Additionally, however, it may be the case that such an athlete will require a heating effect in a colder environment in order to ensure proper circulation, dexterity, and muscle operation occurs without loss of body warmth, yet while necessarily donning clothing that does not impede or otherwise contribute to actual overheating during such a workout event. Basically, there are certainly situations where an athlete may begin a workout in an outdoor cold environment with a certain amount of clothing. As the workout (such as, for example, a long run) continues, the person will invariably exhibit an increase in body temperature such that a need for clothing removal to a certain extent becomes necessary. A garment that will accord at least a certain degree of warmth to reduce such a possibility would thus be desirable, particularly in an effort to reduce the need to overcompensate at the outset of the athlete's workout. Certainly, there are high profile (as an example, insulated fabrics, such as metallized down types, and the like) and thicker garments that allow for a wearer to retain body warmth. However, as alluded to above, these will invariably lead to the need for removal to some extent and can thus become highly uncomfortable as the athlete's body temperature rises. Thus, a garment that may provide both a heating capability in a cold weather environment as well as a cooling potential in a warm weather environment would be highly, particularly if such a garment could be a single type with great comfort for the wearer.

As noted above, this end result has not been easy to accomplish. Certainly, moisture wicking fabrics have been utilized to allow for perspiration removal for greater heat dissipation potential for a wearer. Such materials, however, are typically either breathable cotton based or synthetic fibers with certain finishes applied to effectuate a cotton-like effect to hydrophobic materials (such as a hydrophilic coating applied to polyester fibers, as one example). In either case, the utilization of cotton fabrics alone have proven rather difficult as the level of perspiration typically accorded an athlete also generates bacterial growth after use that is not easy to remove. Even with detergents and fragrances, other than undertaking chlorine bleaching, control of bacterial emissions and other highly undesirable results (i.e., highly pungent scents) is rather difficult. Combine with that the general taste level of athletes to wear non-white colors, and the capability of cotton fabric treatments to impart a necessary control level of sweat-based bacteria and other odors, has proven nearly impossible to achieve. Polyester/cotton blends suffer from similar problems, while 100% polyester and other synthetic fabrics require, as noted above, rather expensive treatments to impart the necessary moisture wicking levels. Ultimately, however, the difficulty still remains to provide a desirable level of scent control, typically undertaken through the utilization of silver ion exchange compounds and other like products applied to the fiber surfaces or, in some situations, extruded or forced into the fibers themselves. Such silver-based materials do provide a level of antibacterial activity, but at a rather high cost. As well, such materials will eventually become depleted after a certain period of time and are not replaced. Thus, in terms of athletic apparel, there still remains a need to impart a combination of effects including antibacterial activity (long-term, preferably) as well as heat dissipation. So far, as noted previously, these results have been extremely limited, if not nonexistent, in combination.

In terms, then, of providing a comfortable garment that provides both cooling and warming effects, to date, there has been no known investigation, let alone accomplishment to that end.

Beyond that deficiency within the current athletic and fitness apparel industry, there also remains a rather taxing problem on the athlete in that the metabolic processes undertaken during such a workout will generate waste products (carbon dioxide, urea, lactic acid, as examples) that can contribute deleteriously to the person's well being. The body necessarily seeks to transport such byproducts of strenuous activity, whether through respiration or via the circulatory system to the excretory system. In any event, the potential for build-up within the body, and particularly in the capillaries and tissues near the surface of the skin, has proven troublesome in the past. Cramping due to excess lactic acid, hyperventilating due to excess carbon dioxide, and other conditions related to circulatory system limitations have created problems for athletes for as long as such activities have been undertaken. The capability of reducing these potential problems without too much external interference (for instance, oxygen masks, continued water intake, and the like) has been difficult to achieve, as well. Furthermore, the necessity for such outside implements and continued ingestion of fluids can be taxing on the person's system as well as increase the expense involved. A means to reduce the dependency on such items, at least to a certain extent, is thus a significant aim in the athletic world. A relatively simple means to accord waste byproduct removal from the target athlete's body without external implements has not been made unavailable in the past. As such, there is almost a "luck of the draw" situation in place for every athlete as it concerns these issues. To make that potential playing field as level as possible would only help to maximize the benefits available for the athlete, rather than suffer limitations that are inherent with one's own physiology.

It has been shown that certain implements may actually aid at least in regulating an athlete's temperature during cool-down periods of workouts such that greater activity potential (and possibly more effective results) can be achieved. For instance, a "glove" has been developed that includes battery-powered capability of drawing heat from an athlete's hand in a controlled environment. This structure is rather expensive, certainly, and has shown a certain level of allowing for localized heat dissipation through a person's hands alone in order to allow for increased circulation and thus, presumably, increased physical activity levels. Unfortunately, the utilization of such a device is limited to those with the funds to expend for such an implement, much like the necessity for oxygen masks and continuous water intake to avoid carbon dioxide and lactic acid build-up issues. The localization of the "glove" does not appear to provide any improvements to such waste byproduct generation, nor is there any means to provide effective heat dissipation other than during an actual cool-down period. The lack of continuous results during an athlete's workout thus would require repetitive activity with breaks that necessarily entail utilization of such an external implement. Again, this adds complexity to a workout, regardless of the potential for improved physical activity levels. There thus still remains a significant need to impart beneficial effects to an athlete during physical activity to improve his or her comfort, possibly impart an anti-bacterial effect for long-term apparel usage purposes, and also potentially provide a means to improve circulation during an activity rather than solely during a cool-down period. To date, such a result, whether in terms of an actual product or a straightforward method, has yet to be provided the athletic world.

Advantages and Summary of the Invention

One distinct advantage of this invention is the provision of an apparel garment that imparts a cooling effect to the user's skin as athletic activity increases and also exhibits a minimal degree of moisture wicking. Another advantage of this invention is the utilization of antibacterial materials that provide both such results on and within the fibers thereof as well as the desired cooling effect on the wearer's skin during use. Yet another distinct advantage of this invention is the relative simplicity of manufacture needed to generate the effects described herein, as well as the further benefits of improved circulation for the wearer during use. Still another significant advantage is the capability of such an inventive garment to provide a warming effect for a wearer when worn and utilized in a cold-temperature athletic situation.

Accordingly, this invention encompasses an apparel garment comprising synthetic fibers including far infrared materials present on the fiber surfaces, within the fibers, or both, wherein said fibers wick moisture from a person's body, wherein said garment will impart a temperature level drop to a person's body during an athletic or fitness workout below that exhibited in relation to a garment made from the same fibers but not including any far infrared materials, wherein said athletic or fitness workout is in an environment exposed to a temperature level of 20° C. and above, and wherein said garment will impart a temperature level increase to a person's body during an athletic or fitness workout in an environment exposed to a temperature level of 12° C. and below. Also encompassed within this invention is the method of undertaking an athletic or fitness workout wearing such an inventive garment wherein said garment imparts a cooling effect to the wearer such that the temperature of the wearer's body covered by said garment measures a lower temperature than that imparted by a garment made from the same fibers but not including any far infrared materials. Additionally, such an inventive garment will exhibit a certain degree of antimicrobial activity, odor reduction capability, or both.

Such an inventive apparel garment has not been made available to the athletic industry. Far infrared materials are well known for various heating and therapeutic effects, but never before has there been any investigation, let alone disclosure, of the cooling effects and, ultimately, the overall comfort level improvement capacity of fabrics including amounts of these materials. These past uses have centered on the radiation emitting capabilities of such materials, rather than on the potential for extraneous benefits that may be present in addition to such outwardly understood properties. As a result, there has been no consideration of anything of use within the athletic and fitness (sports) apparel industry, particularly any garments that also exhibit a certain degree of moisture wicking capability.

Historically speaking, it was initially theorized that a person's body will emit a maximum wavelength at a given temperature. Known as Wien's Law (as derived in In 1893 by Wilhelm Wien), such a result was determined utilizing the following formula:

$$K=T\times\lambda$$

K: Wien's Displacement Constant=2896

T: Temperature of Object in Kelvin (Celsius scale+273)

λ: wavelength in microns

From this basis, it was determined further that the human body emits wavelengths between 4 and 16 microns, a range that overlaps with the infrared wavelength spectrum (between visible light and microwaves) that emits wavelengths between 1.5 and 15 microns (with the range up to 5.6 microns within the medium infrared spectrum and from 8 to 15 microns within the far infrared spectrum). Typically, humans will emit infrared radiation between 8 and 13 microns in wavelength, with an optimal absorption frequency of about 9.4 microns. In these instances, thermal energy is the primary source for such radiation, thus allowing for the application of similar wavelengths of infrared sources to the human body for therapeutic reasons, allowing for enhancements in health and overall performance of the target person.

Additionally, however, it is known that 3.5 to 14 micron wavelength far infrared radiation has a strong resonance effect to compounds exhibiting significant hydrogen bonds. Such compounds are typically polar in structure with dipole-dipole interactions that exhibit electric potentials between about 0.04 and 0.50 eV (electric volts). Generally speaking, again, it has been determined that photon energy (E) is related to electric potential through the following equation, wherein the photon energy is associated with a specific wavelength (λ):

$$\lambda(\mu m)=1.2398(eV-\mu m)/E(eV)$$

As a result, dipole-dipole resonance occurs when exposed to electromagnetic waves having wavelengths between 2.5 microns to 30 microns (i.e., within the far infrared wavelength spectrum).

Taking that into consideration, it is notable that water molecules are polar in nature, having two hydrogen bonds to a single oxygen atom. This hydrogen bonding potential allows for multiple molecules to cohere together, thus generating water in liquid form. These clusters of water molecules are prevalent, of course, throughout nature, and, in particular, within the human body. Making up the majority of the human body, water is the basis of life and is located throughout the body and being constantly transported and/or absorbed for sustenance to occur. Of particular note is the constitution of human blood in this respect. Blood plasma, itself, constitutes approximately 55% of total blood volume, measuring about 91.5% water and 8.5% dissolved solutes (such as proteins and small percentages of nutrients, electrolytes, nitrogenous gases, respiratory gases, and regulatory compounds). Lean muscle is primarily water, as is lung tissue, and other organs. The importance of water within the human body goes without question. For efficient body activity, however, water must be, again, easily transported and/or absorbed throughout the body. During strenuous activity, where the ability to regulate body temperature, remove waste byproducts from muscles, etc., the capability of transporting water molecules for such a purpose reaches its apex. Thus, the better the potential for water movement, through, for instance, reduction of hydrogen-hydrogen bond strengths between water molecules, the greater the capacity for water cluster reduction.

The capability of far infrared materials to emit radiation within the proper range of wavelengths to effectuate hydrogen bonding reductions, the greater effectiveness such materials have, apparently, to increase efficiency of respiration and excretory functions during strenuous activities. Additionally, the ability to transfer photon energy via far infrared radiation also appears to impart a degree of hydrogen bonding reduction, potentially through the generation of symmetrical rotational movement of the bonds to the point of weakening and eventual detachment. This ability to accord suitable emissions to a person's body thus allows for greater propensity to reduce waste byproduct build-up at the skin/apparel interface, at least, as well as allow for greater water absorption and movement within the circulatory system within the same locations. One explanation of the feeling of well-being lies with cellular absorption and elimination. The water that we drink comes in clusters of water molecules. The clusters can range from one molecule to dozens of molecules. As noted above, the clusters are broken up most efficiently in the far infrared ranges. Water cluster size is important in cellular activity. The smaller clusters, working in groups, are able to wrap around ions and transport them. The larger clusters have more difficulty in trapping ions. An additional reason for difficult transport is the size which makes inter-membrane transport easier for smaller clusters and smaller cluster/ion units and difficult for large clusters. Thus, inter-membrane transport, which is important in cellular absorption and elimination, is enhanced with smaller water clusters. Additionally, then, with very small capillaries prevalent at the skin surface, the ability to reduce water clusters within the blood plasma in such small vessels, improves overall efficiency for the athlete. In effect, the decrease in water clusters enables quicker absorption and faster transportation of water, better exchange of respiratory gases, faster delivery of oxygen and nutrients, faster removal of wastes, ultimately, increased circulation.

Thus, it has been determined that the capability of far infrared materials to impart such characteristics to a person's body allows for increases in subcutaneous temperature, enhancement of blood circulation and metabolism, alleviation of pain, facilitate muscle recovery from strains and fatigue as well as many additional benefits. As such, and as noted above, most far-infrared textiles are used for therapeutic, antimicrobial, and/or sanitation purposes. The thermal radiation emitted when far infrared fabrics are applied to the human body creates resonance with the water molecules within the body and sets them into a rotational state and therefore causing a thermal reaction. This thermal reaction dilates the blood vessels and increases the blood circulation. When the blood vessels are dilated and blood circulation is improved then more oxygenized blood and nutrient rich blood reaches the muscles and tissues. Past uses of far infrared (FIR) materials have thus actually been quite limited as it concerns inclusion within fibers and/or fabrics. For examples, therapeutic heating pads have been developed that utilize these heating and circulatory improvement benefits. Localized structures for heating purposes (without the need for external electricity or like power) have also been provided, such as casts, wraps, bandages, and the like. Blankets and sheets have been provided with such materials included in order to provide, again, a heating regimen for therapeutic purposes. Underwear and other heat-requiring textiles have also been provided, particularly for use in extremely cold climates. Otherwise, as noted above, certain metal oxide materials have been provided as antimicrobial substances for fibers and fabrics, though such fibers and fabrics have been utilized primarily for such antimicrobial purposes (hospital sheets, towels, scrubs, etc.) that necessarily center on the potential for bacterial contamination. To date, the utilization of far infrared materials for athletic apparel garments have heretofore been nonexistent.

Such a result is to be expected, however. With the prior utilization of such materials primarily for the purpose of generating heat, the inclusion of any such components within an athletic apparel garment would actually create problems with higher temperatures rather than any comfort effects, particularly as it applies to warm temperature situations. As such, there are no indications that the utilization of far infrared materials within athletic and fitness apparel fabrics was a consideration to any degree due to the general thought that such fabrics were primarily usable in gymnasiums and other higher temperature venues. Certainly, with the propensity for overheating in such milieus, the consideration of materials that actually impart higher temperatures to a user's body would have been totally divergent from the standards of the athletic and fitness industry. As described above, the general need for athletic garments is the capacity to reduce potential problems, such as, again, increased temperatures due to exothermic physical activity in high temperature environments. It is thus surprising, and, without question, counterintuitive, that the utilization of far infrared materials would be suitable for the actual reduction of a person's body temperature rather than an increase of the same. The prior art devices, fabrics, etc., all take into effect the natural capability of such emitting materials to generate heat when placed in contact with human skin. Nowhere has the capability of actually reducing heat under such conditions been explored. The capability of the inventive garments and methods to thus impart continuous heat dissipation results, and thus lower overall body temperature measurements to athletic wearers is highly unexpected.

As such, it is thus important to note that the apparel garment includes any type of fibers that may be manufactured and/or finished with far infrared materials in a reliable manner. To that end, natural (cotton, wool, ramie, hemp, linen, and the like), synthetic (polyesters, polyamides, polyolefins, polyaramids, polyurethanes, acetates, rayon, acrylics, and the like), or inorganic fibers (such as fiberglass, boron-derivative fibers, and the like) may constitute the target fibers and/or yarns, either alone or in any combinations or mixtures of synthetics, naturals, inorganics, or blends such types. As for the synthetic types, for instance, and without intending any limitations therein, polyolefins, such as polyethylene, polypropylene, and polybutylene, halogenated polymers, such as polyvinyl chloride, polyesters, such as polyethylene terephthalate, polyester/polyethers, polyamides, such as nylon 6 and nylon 6,6, polyurethanes, such as spandex (either sheath-core or individual elastomers), as well as homopolymers, copolymers; or terpolymers in any combination of such monomers, and the like, may be utilized within this invention. Nylon 6, Nylon 6,6, polypropylene, and polyethylene terephthalate (a polyester) are particularly preferred, though not required. The selected fiber or yarn may be of any denier, may be of multi- or mono-filament, may be false-twisted or twisted, or may incorporate multiple denier fibers or filaments into one single yarn through twisting, melting, and the like. Of particular preference, however, is a denier range that imparts a comfort level to the wearer; certainly too high a denier would not be easily usable due to the uncomfortable nature such a high denier fiber would exhibit. Furthermore, the yarn may be dyed or colored to provide other aesthetic features for the end user with any type of colorant, such as, for example, poly(oxyalkylenated) colorants, as well as pigments, dyes, tints, and the like. Patterns may be utilized for logos or other ornamental designs, as well. Other additives may also be present on and/or within the target fabric or yarn, including antistatic agents, brightening compounds, nucleating agents, antioxidants, UV stabilizers, fillers, permanent press finishes, softeners, lubricants, curing accelerators, and the like. Particularly desired as optional and supplemental finishes to the inventive yarns or fabrics made therefrom are soil release agents which improve the wettability and washability of the fabric, particularly the generation of the aforementioned moisture wicking properties thereto. Preferred soil release agents include those which provide hydrophilicity to the surface of polyester (or other hydrophobic fiber type). With such a modified surface, again, the fabric imparts improved comfort to a wearer by wicking moisture. Additionally, other potential additives and/or finishes may include water repellent fluorocarbons and their derivatives, silicones, waxes, and other similar water-proofing materials. Odor control additives, as well as scent control materials, may also be applied on or in the constituent fibers or coated on the fabric surfaces, as desired. Synthetic and natural blends may be utilized with the far infrared materials applied to either or both types of fibers, as well. As it is, although it is not particularly preferred, in actuality, any type of moisture wicking natural fibers, such as cotton, ramie, linen, silk, and the like, may be utilized within the garment at issue. The remainder, and up to 100% by weight thereof, is thus preferably synthetic in nature for the purposes of allowing for greater reliability in far infrared material application as well as moisture wicking control and overall lower costs of manufacture. If desired, however, there may be permitted a complete natural fiber garment with the far infrared materials applied thereto, if desired, and which would impart the same temperature lowering and moisture wicking effect. Thus, although synthetic fibers (polyester, polyamide, polyolefin, spandex, and the like, with polyester and spandex blends potentially preferred) are desired as noted above, the utilization of all natural fibers would still fall under the scope of this invention, as long as the apparel garment is one that is athletic in nature, for the reasons discussed herein. An overall directive to utilize such an inventive garment in an athletic workout or other like process is thus encompassed that would include the garment as discussed above, as well. As long as the proper moisture wicking and temperature lowering results are imparted by such a garment during such an athletic procedure, then the invention metes and bounds have been met, in effect. Thus, a certain amount of non-moisture wicking fibers may be included therein as well, including hydrophobic fibers, inorganic fibers, semisynthetic fibers, and the like.

The overall effect imparted by such a unique athletic apparel garment is the continuous capacity for such lower temperature/therapeutic effects throughout the entirety of a person's workout, whether during warm up, actual exercise, or cool down, particularly in a warm temperature milieu, as well as the simultaneous potential to provide increased body warmth when utilized in a cold temperature environment workout. As noted above, the only discussions pertaining to heat dissipation properties of suitable external implements for improved physical activity results lie in the utility of such devices solely during cool down. One could not effectively wear a cooling "glove" during an outdoor run, doing pull-ups, or other like strenuous and arms-free activities; nor would such an implement simultaneously offer the capacity for body temperature increases in cold weather environments. Importantly, then, the inventive garment allows for free range of motion, utilization in any setting, and for any purpose associated with athletic workouts (and the like), while creating a constant cooling effect for the user in a warm weather environment and a suitable warming effect in a cold weather environment. Additionally, however, is the further benefits such a garment contributes to one's overall workout in terms of increased metabolic activity, improved water absorption and transport, and, in effect, better circulatory rates. As described above, the capability of far infrared materials to emit radiation within the narrow spectrum associated not only with the human body's natural wavelengths, but also in a manner that simultaneously functions to reduce hydrogen bonding within substances that are within the proper location for such emissions to reach (such as in the subcutaneous area of the human body where capillaries flourish to transport gases, nutrients, waste products, etc.). In this manner, then, while allowing for greater circulation within the subcutaneous regions (at least those covered by the apparel garment at issue), improved respiration, excretion, etc., at the cellular level in such regions is permitted. In theory, then, without any intention of relying specifically on any determinative conclusion in that respect, it is believed that the resultant capacity of such far infrared materials to impart these multiple activities through transfer (emission, if you will) of radiation from the wearer's garment to the wearer's body, the ability to reduce water clusters, dilate capillaries (and possibly veins), and effectively improve metabolic processes, the overall effect is the reduction in temperature not only experienced by the user during such physical activity, but actually measurable to that effect, particularly, again when exposed to a suitably warm environmental temperature. The same properties appear to provide the simultaneously available heating effect when exposed to a cold temperature during a workout. Again, due to the lack of actual understanding of this possibility in the past, the investigation of utilizing far infrared material-containing fabrics for anything beyond therapeutic heating implements, casts, socks, underwear, and the like, was nonexistent. The ability discovered in this instance of actually increasing the comfort for the athlete wearing such an inventive garment during a workout (or like procedure) is counterintuitive to such past developments (particularly since the same garment can impart targeted heating or cooling effects while retaining a moisture wicking capacity such that the overall comfort of the wearer may be improved regardless of the temperature he or she is exposed to during a workout). Coupled with the capability of imparting antibacterial properties to such garments, as well as allow for the aforementioned circulatory system, etc., improvements that provide even further benefits for the user (and which were, if anything, considered results solely available due to heat generation in relation to such radiation emissions in the past, not in association with actual lower temperature generation as has been discovered with this invention), the overall garment and method of use thereof are highly desirable within the athletic garment industry.

Thus, in terms of the actual far infrared materials themselves, any compounds, composites, structures, etc., that are of sufficiently small size to be properly applied to and/or infused within synthetic and/or natural fibers (and specifically those that provide some degree of moisture wicking, whether in as-made and/or natural state, or imparted with surface modifications to such an effect) in such a manner that at least some amount of materials will remain in such a state after at least 10 typical washes. Such materials thus may be metal oxides (such as oxides of the following elements: Ag, Al, Au, B, Ba, Be, Bi, Br, Ca, Cd, Co, Cr, Cs, Cu, Fe, Ga, Ge, Hf, I, In, Ir, K, Li, Mg, Mn, Mo, Nb, Ni, Os, P, Pb, Pd, Pt, Rb, Re, Rh, Ru, S, Sb, Se, Si, Sn, Sr, Ta, Te, Ti, Tl, V, Zn or Zr), plant fibers (such as bamboo, coffee grounds, rubber, cellulose, algin, mannan, and the like), animal fiber (such as chitin, protein, and the like), carbon fiber, or silicate fiber. These materials may be applied directly to already extruded, spun, or otherwise formed fibers and/or yarns, or may be incorporated within the manufacturing process for such fibers (particularly those that are synthetic in nature, for obvious reasons) in order to allow for introduction of such materials within the fibers. In either case, with an aim to introduce a suitable amount of such materials to the fibers therein, an amount of far infrared materials is introduced within a fiber manufacturing process or as a fiber treatment step such that these materials are present in an amount of from about 0.25 to 5.0% of the weight of the fiber (owf), preferably from about 0.5 to about 3.0%, more preferably from about 0.75 to about 2.0%, and most preferably from about 1 to 1.5%. The fibers are then introduced within a target fabric from about 30 to about 100% composition thereof, preferably about 40 to 95%, and most preferably from about 50 to about 90%. In this manner, the percentage of fiber within the fabric (and thus ultimately within the finished garment within which the fabric is incorporated) that includes the initial 1 to 1.5% owf far infrared materials should meet this 30-100% rough range (again, most preferably from about 50 to 90%). If post-manufacturing, spinning, etc., is undertaken for material application, then such a process may include a suitable adhesive to best ensure proper adhesion thereof to the subject fibers. Upon manufacture, the fibers may be properly woven, knit, or laid into a nonwoven structure and into the desired athletic apparel garment. A knit structure is potentially preferred for proper density and sewing structures, although a woven fabric may be provided that is cut and sewn as necessary to meet the body structure of a wearer, as well.

DETAILED DESCRIPTION OF THE DRAWINGS AND PREFERRED EMBODIMENT

Figure 1:
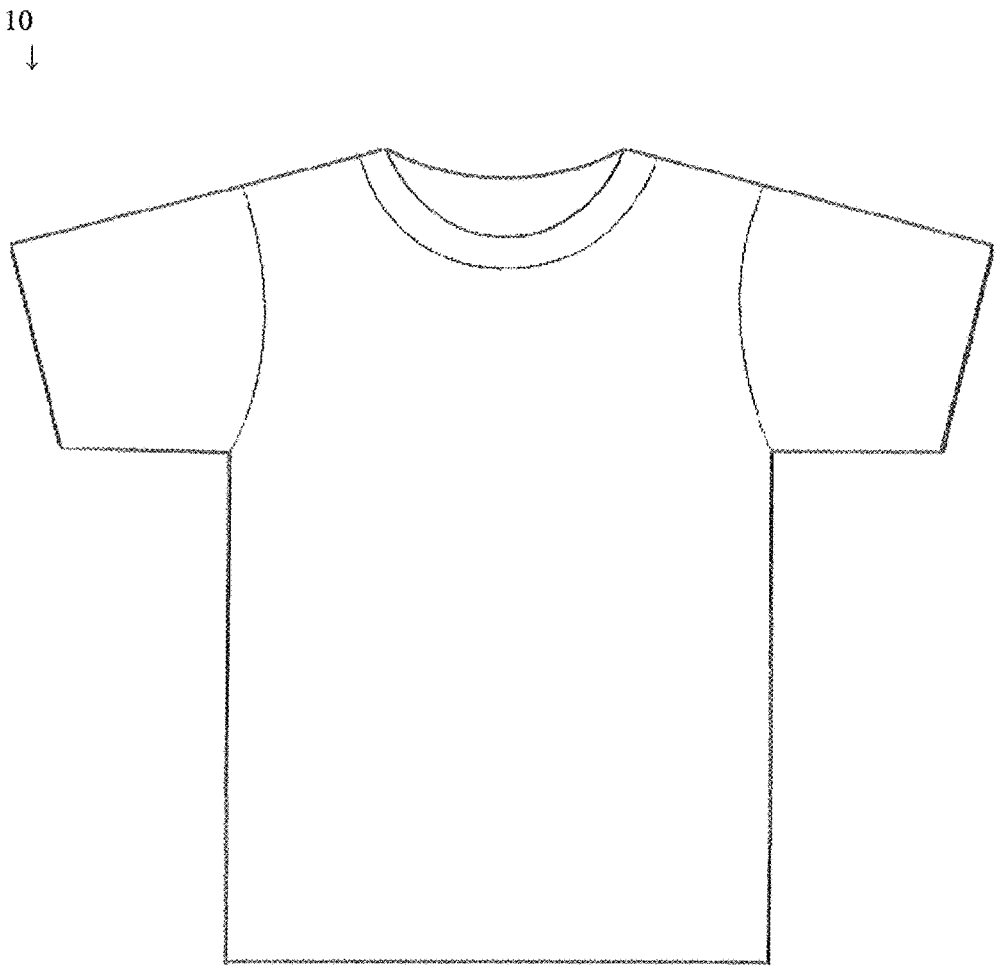
FIG. 1 is a side view of one possible embodiment of an inventive short-sleeve shirt that includes the requisite amount of far infrared materials therein.
Figure 2:
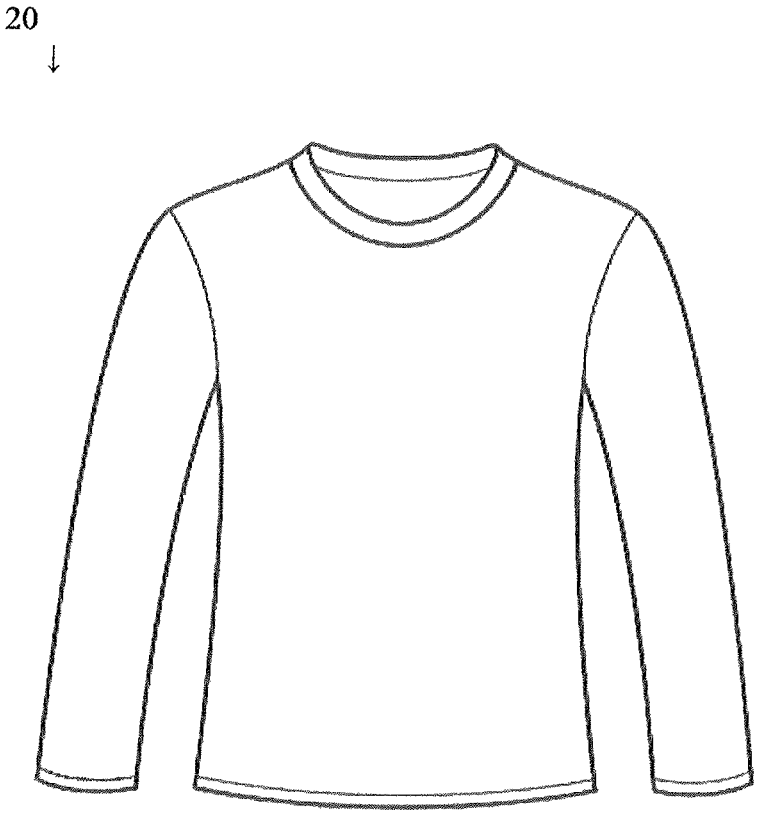
FIG. 2 is a side view of one possible embodiment of an inventive long-sleeve shirt that includes the requisite amount of far infrared materials therein.

Included below are non-limiting examples of the inventive apparel garments and methods of use thereof. These examples are not intended to provide to the scope of the overall invention, but merely as presentations of the manner of production and utilization thereof that fall within such scope. The ordinarily skilled artisan within this area would fully understand the actual metes and bounds thereof as a result.

The invention will be described by referring to FIGS. 1-11 below as well. Such drawings are actually thermographs and microphotographs of scanning electron microscope views of various structures. Again, such drawings are not intended to provide any degree of limitation of the overall inventive apparel garment and/or method of use embodied herein.

As such, the effects of adding far infrared emitting material to moisture wicking textiles to achieve superior performance in aerobic activities as well as odor absorption through anti-bacterial and therapeutic effects relating to the present invention will become more apparent from the following examples.

Inventive Garment Production

Inventive Example 1

A men's short sleeve compression shirt (such as 10 in FIG. 1), made of 11% spandex elastic fiber and 89% polyester fiber was provided. The fibers were produced with metal oxides containing potassium, magnesium, calcium carbonized material (K 0.85, Na 0.01, Ca 0.05, Mg 0.04, Fe 0.01, Mn 0.05) mixed spun therein. The metal oxides were introduced within the spinning process in an amount of about 1.5% by weight of the polyester feedstock. The resultant fibers were of 125 b/m$^2$ denier, respectively, and exhibited moisture wicking and antimicrobial properties. Such fibers were then combined together into a knit structure as a men's compression shirt (large) with the far infrared materials utilized in an amount of about 1.34% of the finished shirt (89% times 1.5%).

Inventive Example 2

A men's long-sleeve compression shirt (such as 20 in FIG. 2) made of 11% spandex elastic fiber and 64% polyester fiber was provided. These fibers were produced with about 1.5% of metal oxides containing potassium, magnesium, calcium carbonized material (K 0.85, Na 0.01, Ca 0.05, Mg 0.04, Fe 0.01, Mn 0.05). Additionally, 25% rayon fiber was used for the shirt 20 and were prepared with a 1.5% concentration mixture of metal oxides containing potassium, magnesium, calcium carbonized material (K 0.85, Na 0.01, Ca 0.05, Mg 0.04, Fe 0.01, Mn 0.05) mixed spun therein. The resultant fibers were of 275 b/m$^2$ denier, respectively, and exhibited moisture wicking and antimicrobial properties. Such fibers were then combined together into a knit structure as a long-sleeve (men's) compression shirt 20 (large) with the far infrared materials utilized in an amount of about 1.34% of the finished shirt (64%+25% times 1.5%).

Comparative Example 1

A sports apparel industry leader's men's short-sleeve moisture wicking compression shirt made of 18% spandex elastic fiber and 82% polyester was provided. Such a comparative shirt was the same size as in Inventive Example 1, but did not include any far infrared materials therein (such as metal oxides).

Comparative Example 2

A sports apparel industry leader's men's short-sleeve moisture wicking compression shirt made of 63% nylon, 23% polyester and 14% spandex elastic fiber was provided. Such a comparative shirt was the same size as in Inventive Example 2, but did not include any far infrared materials therein (such as metal oxides).

Comparative Example 3

A sports apparel industry leader's men's short sleeve moisture wicking compression shirt made of 100% polyester was provided. Such a comparative shirt was the same size as in Inventive Example 2, but did not include any far infrared materials therein (such as metal oxides).

Inventive Garment and Method Analysis—

Athletic Test 1

The shirts described in Inventive Example 1 and Comparative Example 1 were worn by the same test subject while jogging 12 minutes on a LifeFitness® 95TI treadmill with a zero-degree incline for a distance of 1.5 miles or 2.414 kilometers. The subject jogged with the Inventive Example 1 shirt on first and then rested for 2 hours before undertaking the Test for Comparative Example 1. The speed setting on the LifeFitness® 95TI treadmill was 7.5 for the entire duration of both Tests. The room temperature in the laboratory was 72 degrees Fahrenheit or 22.22 degrees Celsius. The subject then experienced a slow walk cool down period of 30 seconds after completing the 1.5 mile or 2.414 kilometer workout. After the 30 seconds was over, the test subject's image was taken with a FLIR i40 thermal imaging camera.

Figure 3:
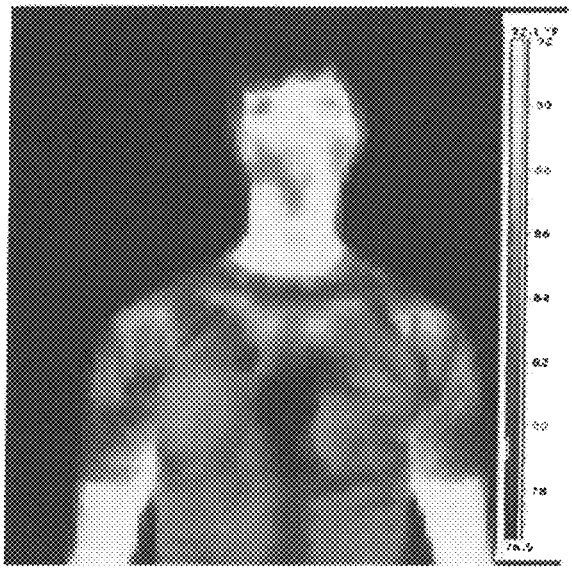
FIG. 3 is a thermograph (FLIR i40 spectral range 7.5-13 microns: infrared radiation thermometer 20° C. to +120° C.) of a test subject wearing an inventive short-sleeve shirt 30 seconds after a standardized workout.
Figure 4:
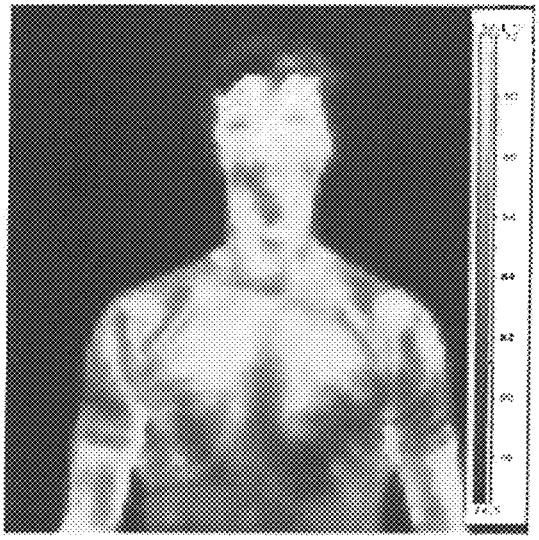
FIGURE 4 (PRIOR ART)
FIG. 4 is a thermograph (FLIR i40 spectral range 7.5-13 microns: infrared radiation thermometer 20° C. to +120° C.) of a test subject wearing a prior art short-sleeve shirt 30 seconds after a standardized workout.
Figure 5:
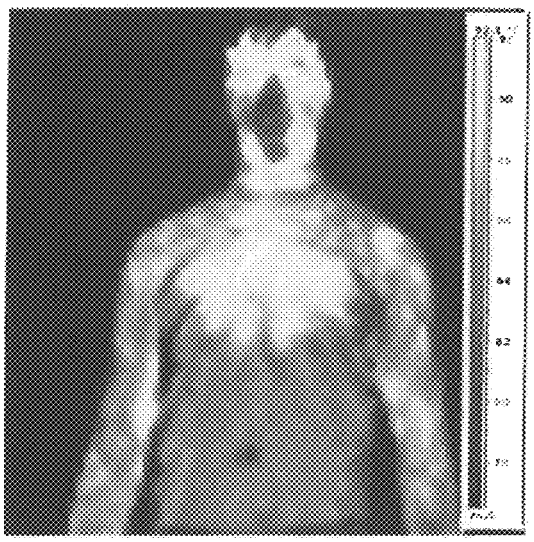
FIG. 5 is a thermograph (FLIR i40 spectral range 7.5-13 microns: infrared radiation thermometer 20° C. to +120° C.) of a test subject wearing a different inventive long-sleeve-shirt 30 seconds after a standardized workout.

The measured temperatures in this test were obtained from the thermograph (FLIR i40 spectral range 7.5-13 microns: infrared radiation thermometer 20° C. to +120° C.). The temperature scale in the images indicates the surface temperature of Inventive Example 1 and Comparative Example 1, where the darker colors indicate a cooler temperature and the lighter colors indicate a warmer temperature. FIG. 3 thus shows the result for Inventive Example 1 and FIG. 4 the same for Comparative Example 1. The measured temperatures in these tests were calculated from minimum, average, and maximum values of the picture analysis temperature distribution of the upper chest of the thermograph of the participant. Table 1 shows the measured temperature results:

TABLE 1

| Temperature Measurements for Test 1 | | |
|---|---|---|
| | Inventive Example 1 | Comparative Example 1 |
| Minimum (° F.) | 76.5 | 80 |
| Maximum (° F.) | 86 | 91 |
| Average (° F.) | 80 | 87 |

As clear from the images, the capacity of Inventive Example 1 to keep the body cooler during cardiovascular and aerobic exercise is displayed, which is counterintuitive from the expected generation of heat from far infrared materials as compared with a garment not included any such materials at all. When the mixed spun 89% spandex elastic fiber and 11% polyester fiber mixed with metal oxides containing potassium, magnesium, calcium carbonized material provides a significantly cooler surface temperature. The increased blood from wearing 89% spandex elastic fiber and 11% polyester fiber mixed with metal oxides containing potassium, magnesium, calcium carbonized material causes an increase in blood flow to the area it is worn specifically in the tested area of the chest so the body's natural cooling mechanism to send more blood flow to the skin to be cooled is enhanced with the increase in blood flow therefore keeping the body cooler than Comparative Example 1.

Athletic Test 2

The shirts described in Inventive Example 2 and Comparative Example 2 were worn by the same test subject while jogging 12 minutes on a LifeFitness® 95TI treadmill with a zero-degree incline for a distance of 1.5 miles or 2.414 kilometers. The subject jogged with the Inventive Example 2 shirt on first and then rested for 2 hours before undertaking the Test for Comparative Example 2. The speed setting on the LifeFitness® 95TI treadmill was 7.5 for the entire duration of both Tests. The room temperature in the laboratory was 72 degrees Fahrenheit or 22.22 degrees Celsius. The subject then experienced a slow walk cool down period of 30 seconds after completing the 1.5 mile or 2.414 kilometer workout. After the 30 seconds was over, the test subject's image was taken with a FLIR i40 thermal imaging camera.

The measured temperatures in this test were obtained from the thermograph (FLIR i40 spectral range 7.5-13 microns: infrared radiation thermometer 20° C. to +120° C.). The temperature scale in the images indicates the surface temperature of Inventive Example 2 (FIG. 5) and Comparative Example 2 (FIG. 6) where the darker colors indicate a cooler temperature and the lighter colors indicate a warmer temperature. The measured temperatures in this test were calculated from minimum, average, and maximum values of the picture analysis temperature distribution of the upper chest of the thermograph of the participant. Table 2 shows the measured temperature results:

TABLE 2

| Temperature Measurements for Test 2 | | |
|---|---|---|
| | Inventive Example 2 | Comparative Example 2 |
| Minimum (° F.) | 76 | 81 |
| Maximum (° F.) | 86 | 91 |
| Average (° F.) | 80 | 87 |

Figure 6:
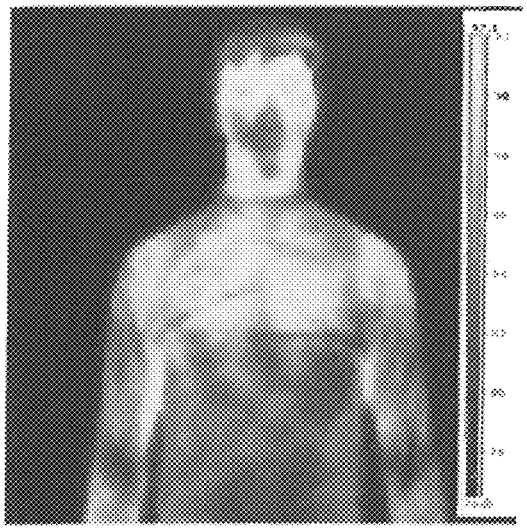
FIGURE 6 (PRIOR ART)
FIG. 6 is a thermograph (FLIR i40 spectral range 7.5-13 microns: infrared radiation thermometer 20° C. to +120° C.) of a test subject wearing a different prior art long-sleeve shirt 30 seconds after a standardized workout.

As clear from the images, the capacity of Inventive Example 2 (FIG. 5) to keep the body cooler during cardiovascular and aerobic exercise is displayed, which is, again, counterintuitive from the expected generation of heat from far infrared materials as compared with a garment not included any such materials at all. The increased blood from wearing Inventive Example 2 with metal oxides containing potassium, magnesium, and calcium carbonized material causes an increase in blood flow to the area it is worn specifically in the tested area of the chest. The increase in blood flow kept the body cooler than Comparative Example 2 (FIG. 6).

Likewise, the inventive shirts, above, exhibited the capability of generating heat levels to the wearer in a cold temperature environment. The comparative shirts did not exhibit such a property.

Deodorant Test

The garments used in Athletic Tests 1 and 2 were further kept for analysis in terms of smells associated with typical workout results. The general results undertaken by an objective smell test by a panel of observers was that the Inventive Examples were far less pungent after being allowed to sit after removal from the test subject and dry on a uniform surface. The Comparative Examples were far more aromatic in comparison.

Empirical Analyses

A scanning electron microscope (SEM) was used to take images of Inventive Example 1, Inventive Example 2, Comparative Example 1, Comparative Example 2, and Comparative Example 3. The images were used to demonstrate the presence of additive of metal oxides containing potassium, magnesium, calcium carbonized material (K 0.85, Na 0.01, Ca 0.05, Mg 0.04, Fe 0.01, Mn 0.05) on the fabric in Inventive Example 1 and Inventive Example 2 and the non-existence of any additive on or in Comparative Example 1, Comparative Example 2, and Comparative Example 3. FIGS. 5 through 9 display these SEM images (300+ times magnification).

Figure 7:
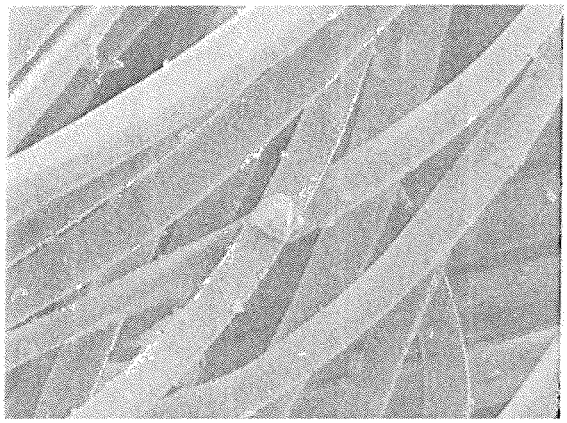
FIG. 7 is a scanning electron microscope (SEM) image (325 times) of individual fibers of the fabric described in Example 1.
Figure 10:
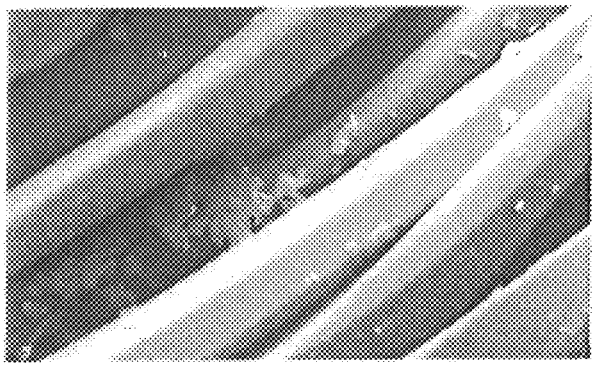
FIG. 10 is a scanning electron microscope (SEM) image (325 times) of individual fibers of the fabric described in Example 2.

The white dots in the magnified SEM images of FIGS. 7 and 10 demonstrate the presence of the metal oxides embedded in those fabric examples.

Figure 8:
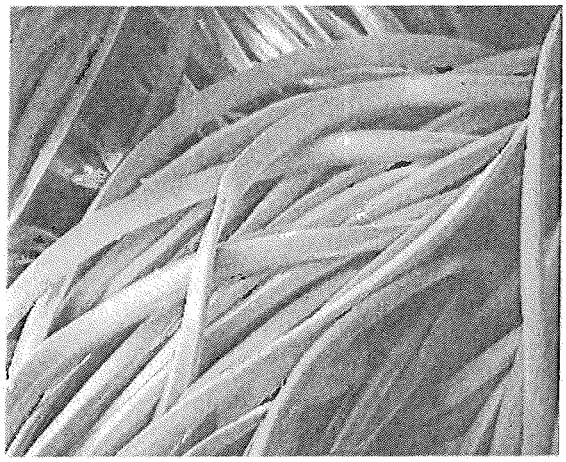
FIGURE 8 (PRIOR ART)
FIG. 8 is a scanning electron microscope (SEM) image (308 times) of individual fibers of the fabric described in Comparison 1.
Figure 9:
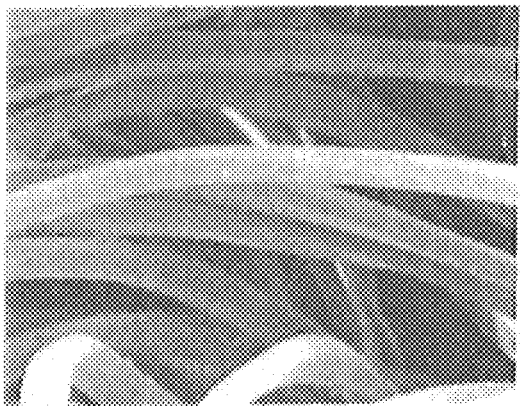
FIGURE 9 (PRIOR ART)
FIG. 9 is a scanning electron microscope (SEM) image (306 times) of individual fibers of the fabric described in Comparison 2.
Figure 11:
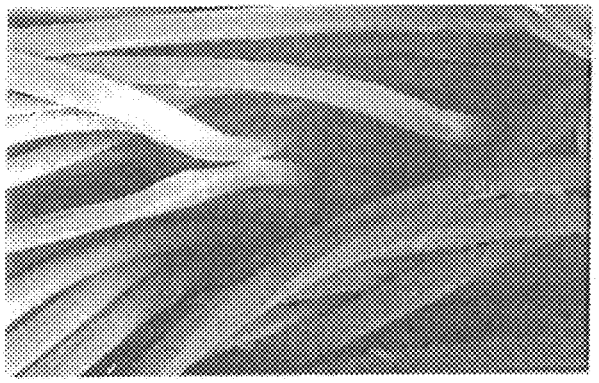
FIGURE 11 (PRIOR ART)
FIG. 11 is a scanning electron microscope (SEM) image (300 times) of individual fibers of the fabric described in Comparison 3.

In comparison, none of FIG. 8, 9, or 11 show any similar results under high magnification, thus indicating no metal oxides or like materials are present.

Thus, as shown above, the present invention of the fabrication and application of a far-infrared emitting material to moisture wicking textiles is applied to the skin; it can effectively activate water molecules, cellular function and other chemistry in the human body necessary for aerobic and anaerobic exercise. As a result, this invention will enhance blood circulation and metabolism of human body and help the body in all three phases of a workout from warm-up, performance of the exercise and recovery, particularly to provide not only improved metabolic and circulatory results for the user, but also the unexpected benefit of reduced body temperature over such a time frame in a warm weather environment, and, simultaneously, the capability of increasing body temperature in cold environments, thus according a beneficial level of comfort for the wearer without the need for a change in garments. With deodorizing and/or antibacterial effects accorded the user with such far infrared materials as well, the overall invention thus accords a highly effective result that has heretofore not been contemplated, for reasons described herein, within the athletic apparel industry.

A complete disclosure of the details and essence of this invention has been made, and the best modes of practicing it as now contemplated have been presented. It will be apparent to all skilled in the art that modifications, substitutions and additions may be made in the elements of the invention without departing from its concepts, the scope of which is defined and limited only by the ensuing claims.

What I claim is:

1. A moisture-wicking, temperature-regulating apparel garment comprising synthetic fibers including far infrared materials present on the surfaces thereof, within the fibers thereof, or both thereon and within said fibers, wherein said fibers wick moisture from a person's body, and wherein said garment regulates temperature through imparting i) a temperature level decrease to a person's body, during an athletic or fitness workout while wearing said garment in an environment exposed to a temperature level of 200 C, greater than the temperature level decrease imparted by a worn garment made from the same fibers but not including any far infrared materials thereon or therein and ii) a temperature level increase to a person's body during an athletic or fitness workout while wearing said garment in an environment exposed to a temperature level of 120 C and below; wherein said far infrared materials are a combination of potassium oxide, magnesium oxide, calcium oxide, manganese oxide, and iron oxide, wherein the majority of the oxide present is potassium oxide, and wherein said garment includes from about 30% to 100% of synthetic fibers including from 0.25% to 5.0% of the weight of the fiber (owf) of said far infrared materials.

2. The apparel garment of claim 1 wherein said garment includes a blend of different synthetic fibers.

3. The apparel garment of claim 1 wherein said far infrared materials have been incorporated therein through direct application, within a fiber manufacturing process, and any combination thereof.

4. The apparel garment of claim 1 wherein said wherein said far infrared materials are present from 1 to 1.5% owf of said synthetic fibers.

5. The apparel garment of claim 1 that further exhibits odor control capability, antimicrobial activity, or both.

6. A method of undertaking an athletic or fitness workout, said workout comprising the steps of:

a) providing a garment as described in claim 1;

b) having an individual wear said garment; and c) having said individual undertake said workout while wearing said garment.

7. The apparel garment of claim 1 wherein said garment is a shirt.

8. The apparel garment of claim 7 wherein said far infrared materials have been incorporated therein through direct application, within a fiber manufacturing process, and any combination thereof.

9. The apparel garment of claim 8 wherein said garment wherein said far infrared materials are present from 1 to 1.5% owf of said synthetic fibers.

10. The apparel garment of claim 7 that further exhibits odor control capability, antimicrobial activity, or both.

11. A method of undertaking an athletic or fitness workout, said workout comprising the steps of:

a providing a garment as described in claim 7;

b) having an individual wear said garment; and c) having said individual undertake said workout while wearing said garment.

* * * * *